US008807467B2

(12) United States Patent
Schwelling

(10) Patent No.: US 8,807,467 B2
(45) Date of Patent: Aug. 19, 2014

(54) SHREDDER

(76) Inventor: Hermann Schwelling, Salem (DE)

( * ) Notice: Subject to any disclaimer, the term of this patent is extended or adjusted under 35 U.S.C. 154(b) by 0 days.

(21) Appl. No.: 12/311,880

(22) PCT Filed: Oct. 18, 2007

(86) PCT No.: PCT/EP2007/009017
§ 371 (c)(1),
(2), (4) Date: Apr. 16, 2009

(87) PCT Pub. No.: WO2008/046608
PCT Pub. Date: Apr. 24, 2008

(65) Prior Publication Data

US 2010/0187341 A1 Jul. 29, 2010

(30) Foreign Application Priority Data

Oct. 18, 2006 (CN) ..... 2006 2 0065832 U

(51) Int. Cl.
*B02C 25/00* (2006.01)
*B02C 18/00* (2006.01)
*B02C 18/16* (2006.01)

(52) U.S. Cl.
CPC ..... *B02C 18/0007* (2013.01); *B02C 2018/0023* (2013.01); *B02C 2018/168* (2013.01)
USPC ..... 241/36; 241/37.5; 241/236

(58) Field of Classification Search
CPC ..... B02C 2018/0007; B02C 18/0007
USPC ..... 241/36, 34, 236, 100, 37.5
See application file for complete search history.

(56) References Cited

U.S. PATENT DOCUMENTS

| | | | | |
|---|---|---|---|---|
| 6,550,701 | B1 | 4/2003 | Chang | |
| 7,303,158 | B1 * | 12/2007 | Abramson et al. | 241/30 |
| 7,490,786 | B2 * | 2/2009 | Matlin et al. | 241/36 |
| 7,500,627 | B2 * | 3/2009 | Park et al. | 241/36 |
| 7,661,614 | B2 * | 2/2010 | Matlin | 241/37.5 |
| 2006/0054725 | A1 | 3/2006 | Matlin | |
| 2007/0057099 | A1 * | 3/2007 | Kubo et al. | 241/101.2 |

FOREIGN PATENT DOCUMENTS

| | | |
|---|---|---|
| DE | 38 19 285 | 12/1989 |
| DE | 44 37 348 | 4/1996 |
| GB | 2 171 029 | 8/1986 |
| GB | 2378404 | * 12/2003 |

OTHER PUBLICATIONS

International Search Report.

* cited by examiner

*Primary Examiner* — Mark Rosenbaum
(74) *Attorney, Agent, or Firm* — Collard & Roe, P.C.

(57) ABSTRACT

The invention relates to a shredder for cutting up data storage media, for example sheet-like materials (paper, stacks of paper, etc.), CD-ROMs, DVDs, floppy disks or articles of that kind, the material feed of which is assigned a switching device for at least automatically starting its cutting tool when materials to be shredded are being fed, in particular an office shredder whose feed opening of the material feed, which leads to the cutting tool, is assigned at least two signal-emitting sensors which are arranged at a distance from one another and are operatively connected to a control unit by means of circuitry.

14 Claims, 3 Drawing Sheets

SHREDDER

CROSS REFERENCE TO RELATED APPLICATIONS

Figure 1:
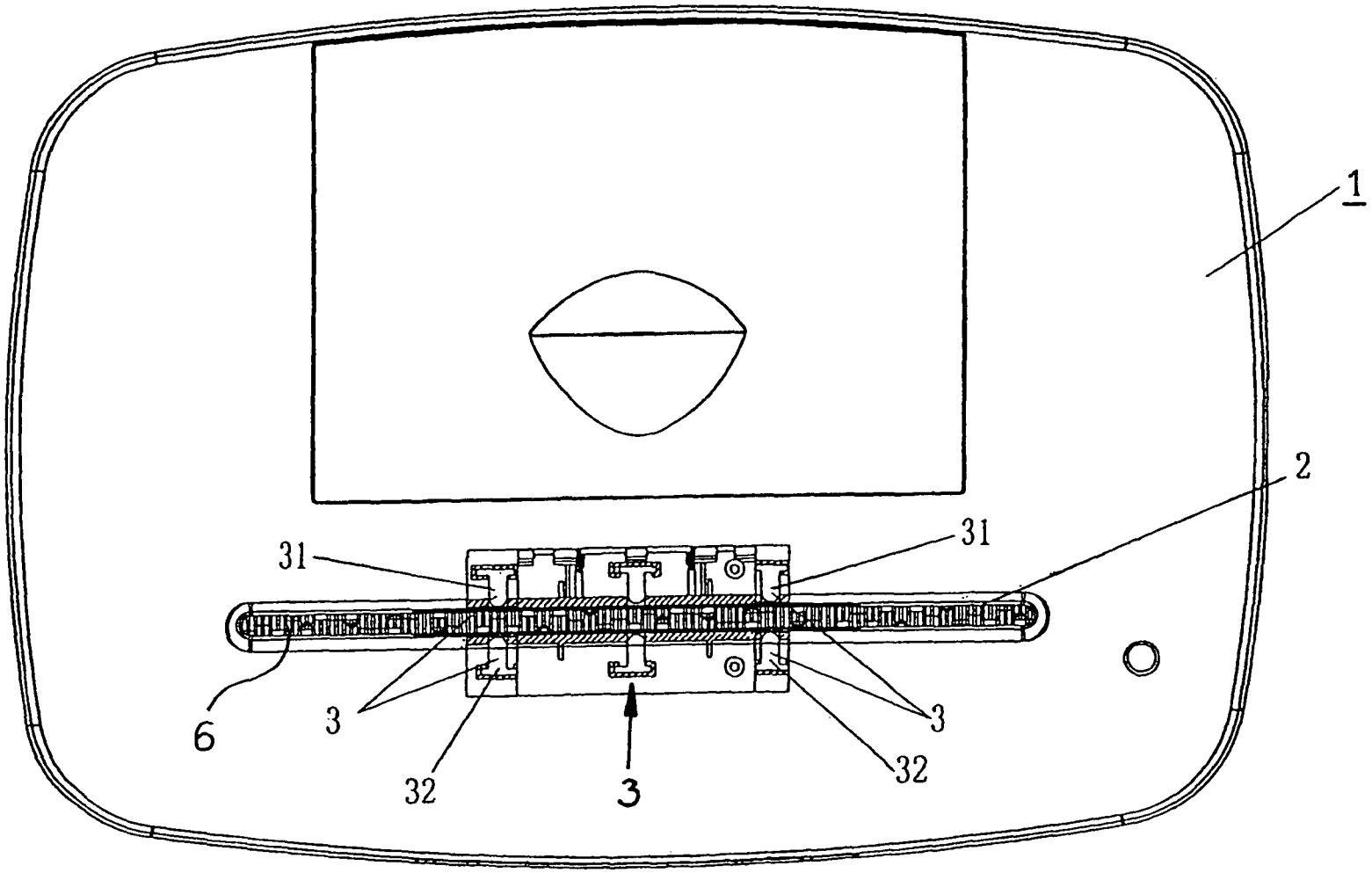

This application is the National Stage of PCT/EP2007/009017 filed on Oct. 18, 2007, which claims priority under 35 U.S.C. §119 of Chinese Application No. 2006 20 065 832.2 filed Oct. 18, 2006. The international application under PCT article 21(2) was not published in English.

TECHNICAL FIELD

The invention relates to a file shredder for shredding data carriers, such as, for example, material in sheet form (paper, stacks of paper, etc.), CD-ROMs, DVDs, diskettes, or similar objects, the material feed of which has a switching device for at least automatic start of its cutting mechanism when material to be shredded is fed in; in particular, an office file shredder.

STATE OF THE ART

Data shredders/file shredders are known in a plurality of embodiments. For example, it is provided, in the case of one construction of file shredders/data shredders, that in order to increase the ease of operation, a switching device is assigned to their material feed region, which outputs a signal for turning on the cutting mechanism during the feed of data carriers/material to be shredded. A file shredder having such an automatic turn-on device is disclosed in DE 38 19 285 A1, GB 2 171 029 A, or DE 44 37 348 A1.

The aforementioned automatic turn-on device is used both in the case of file shredders/data shredders in an embodiment as a large device, and in an embodiment as what is called an office device. Since file shredders/data shredders have come into increasing use also in households, in the embodiment as office equipment, greater demands are being made on the safety requirements of these devices, in order to avoid that children or animals who are part of the household, and do not have any awareness of safety, or adults having very small fingers, do not injure themselves with the cutting mechanism of a file shredder/data shredder. At present, many accidents occur that involve finger injuries of children.

Thus, safety devices are known in various embodiments. According to one construction, these are mechanical flaps or mechanical barriers that correspondingly narrow the material feed region, at least its end section.

This, however, in turn has the disadvantage that because of such a narrow feed gap/channel of the material feed region, relatively little material can be fed to the cutting mechanism during a specific period of time, and this has a negative effect on the throughput, in other words on the efficiency of the file shredder.

Furthermore, safety devices are known in such a manner that proximity switches, particularly those that act in capacitative, inductive, mechanical or/and optical manner, are disposed in the material feed region, and respond, i.e. shut the cutting mechanism down, if non-typical material is being fed in, or if a body part of a human or an animal touches a section of the material feed region, or comes too close to it.

Such a configuration of file shredders does increase safety, but has the disadvantage that in the case of non-careful operation of the file shredder/data shredder, in other words if the material feed region in question is unintentionally touched, or if someone reaches into it, the cutting mechanism is shut off.

This can cause a significant disruption of the work flow, and reduces the efficiency of the device.

STATEMENT OF THE PROBLEM

The invention is based on the task of improving a file shredder/data shredder having the said construction, particularly of increasing the operational safety, without reducing the efficiency; furthermore, the technical and cost-side effort and expenditure for the safety device is supposed to be slight.

SOLUTION FOR THE PROBLEM

The task is accomplished, according to the invention, by means of a file shredder having the characteristics described herein. Further developments and embodiment variants of the invention are also disclosed herein.

In the case of a file shredder having a cutting mechanism disposed in a housing, to which mechanism a drive unit is assigned, a control unit that stands in an effect connection with the drive unit, a feed opening that is let into the housing and leads to the cutting mechanism, and a sensor assigned to the feed opening, for automatic start of the cutting mechanism, which sensor is connected with the control unit, in terms of circuit technology, for automatic start of the cutting mechanism, another, in other words at least two signal-giving sensors are assigned to the feed opening, whereby same are disposed at a distance from one another.

These at least two signal-giving sensors are tied into a circuit configuration disposed in the control unit in such a manner that the control unit does not send a turn-on signal to the drive unit of the cutting mechanism until a signal from at least two sensors, in each instance, arrives in the circuit configuration.

Only once the material introduced into the feed opening and to be shredded addresses two sensors disposed spaced apart from one another, is a signal for turning on the drive of the cutting mechanism triggered. In order to obtain great operational reliability, it is preferably provided, in this connection, that the distance between two adjacent sensors, in each instance, is greater than the width of a standard hand.

According to one embodiment, the horizontal distance between two adjacent sensors is equal to or greater than 60 mm.

According to another embodiment, it is provided that the signals of at least two sensors must arrive in the circuitry within a predetermined, preferably variably adjustable time span.

In order to achieve great operational reliability, it is preferably preferred that the said time span is equal to or less than two seconds.

For greater operational reliability, according to another embodiment, more than two sensors are assigned to the feed device. Preferably, another, third sensor is additionally provided in the feed opening, disposed offset at a vertical distance from the other sensors, along with the horizontal distance already mentioned. Preferably, this vertical distance between two adjacent sensors is equal to or greater than 30 mm.

Depending on the purpose of use for which the file shredder in question is designed, sensors of a photoelectronic, mechanical, pneumatic, acoustical, electrical/electronic, or optical construction are used within the scope of the invention, whereby a combination of sensors of different constructions is also provided, particularly if objects having very different composition or very different materials are shredded using one and the same file shredder. For example, in the case of planned use of the file shredder for shredding primarily data carriers made of paper, in sheet form, sensors having a mechanical construction are disadvantageous, since these sensors could be impaired in their function by the unavoidable formation of dust (clogging of gaps with paper dust, shut-down of moving components resulting from this).

A file shredder/data shredder in at least one of the new embodiments mentioned above offers great operational reliability and is therefore extremely well suited for use in the household or at locations with a lot of public traffic.

Non-typical actions when using the file shredder, which primarily occur by persons not familiar with operation of the file shredder/data shredder, do not lead to start-up of the unit of the file shredder that brings danger with it, the cutting mechanism. For example, a child playing with the file shredder cannot activate all the required sensors, and a human hand also cannot contact all the sensors at the same time, but this is required to generate a switching signal to turn the cutting mechanism on.

According to another embodiment of the invention, it is furthermore provided that a turn-on operating readiness of the drive unit is fundamentally canceled out if a second sensor is not addressed within the predetermined time window after first activation of one of the sensors. After such an event has occurred, the main switch of the file shredder/data shredder, which can also be a combination switch (turn-on/waiting state/reverse), must be repositioned in order to restore the waiting state originally set.

EXEMPLARY EMBODIMENTS OF THE INVENTION

Figure 2:
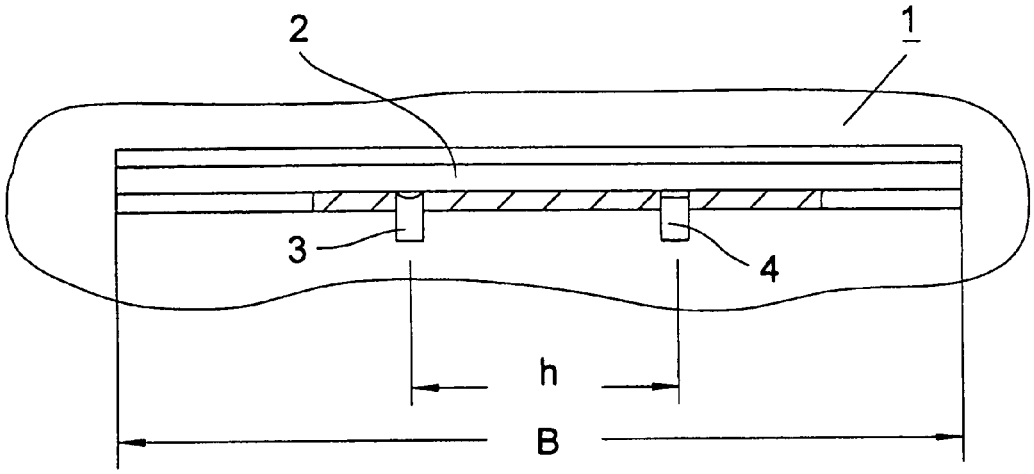
Figure 3:
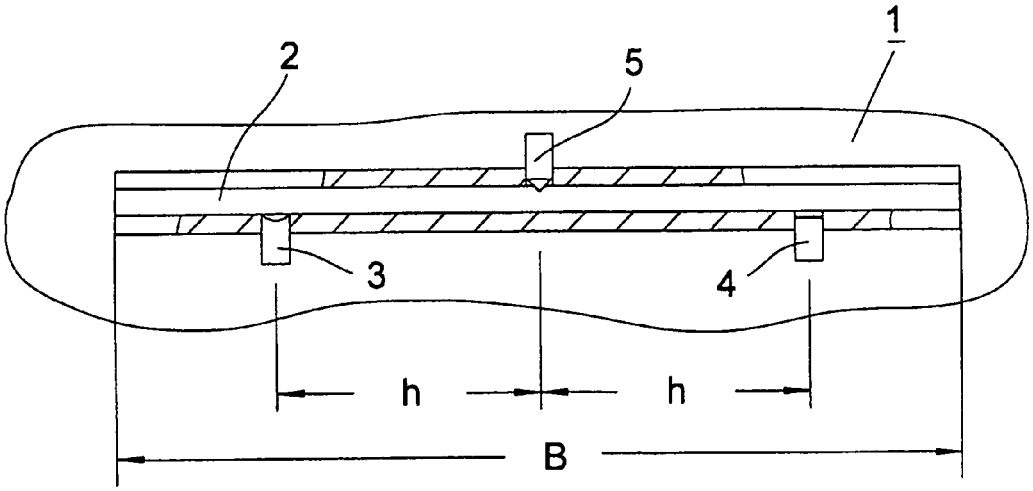
Figure 4:
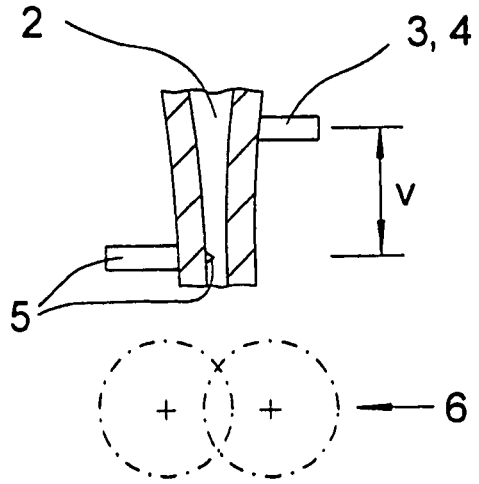
Figure 5:
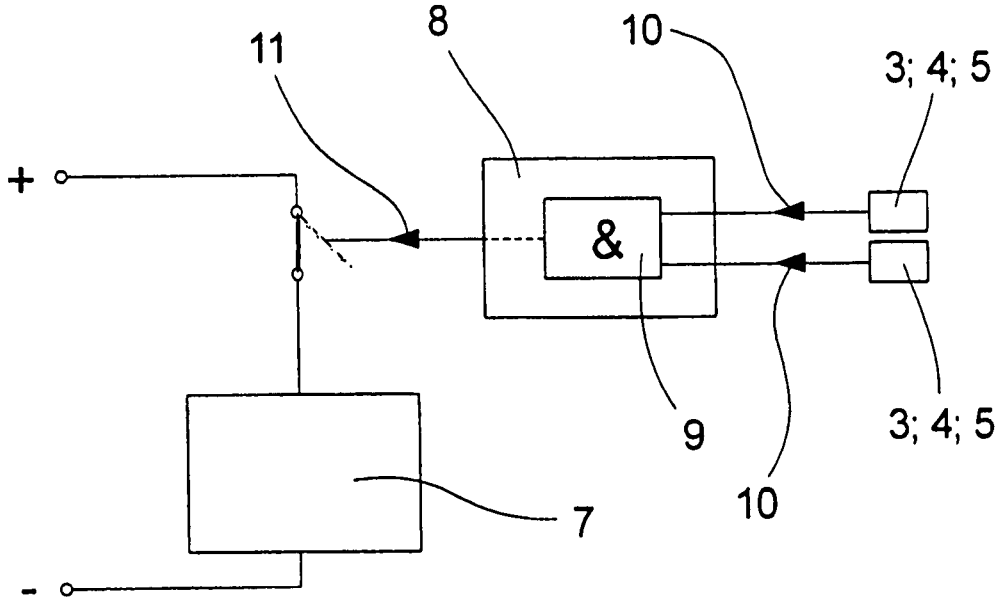

The invention will be explained in detail and further in the following, using exemplary embodiments shown schematically in drawings. In this connection, the drawing shows:

FIG. 1 a view from above onto the new file shredder;

FIG. 2 schematically, the new assignment of the sensors at the feed opening;

FIG. 3 another example of the arrangement of the sensors according to the invention;

FIG. 4 a side view, in section, of the representation according to FIG. 3; and FIG. 5 a schematic of the functional principle for turning on the cutting mechanism of the new file shredder.

The new file shredder having the arrangement of the sensors 3; 4; according to the invention is shown schematically in FIGS. 2 to 4, partly in section.

In FIG. 1, the new arrangement of the sensors, here photoelectronic sensors 3, which are formed by an optical transmitter 31 and an optical receiver 32, is shown. The observer's view is directed at the feed opening 2 disposed in the housing 1. At the bottom of the feed opening 2, partial regions of the cutting mechanism 6 can be seen. The optical transmitters 31 and optical receivers 32 are disposed above the cutting mechanism and on both sides of the feed opening 2, on the latter. In the exemplary embodiment shown, three photoelectronic sensors 3 are provided, which are disposed spaced apart from one another, in each instance, in a horizontal plane.

According to the schematic representation in FIG. 2, a photoelectronic sensor 3 and a sensor 4 having a different construction are disposed on the feed opening 2, in another exemplary embodiment. Within the overall width "B" of the feed opening 2, the two sensors 3 and 4 are disposed spaced apart from one another by a distance "h" in a horizontal plane. The amount of the distance "h" is at least equal to the width of a standard hand, preferably equal to or greater than 60 mm.

In FIGS. 3 and 4, another exemplary embodiment is shown, in which three sensors having different constructions are used. In addition to the first photoelectronic sensor 3 and the second electrical/electronic sensor 4, here a third, mechanical sensor 5 is also disposed on the feed opening 2. The sensor 3 and the sensor 4 are—see FIG. 4—disposed in one plane, which lies in the upper region of the feed opening 2, and the sensor 5 is disposed in a plane that lies lower. The distance between these two planes is marked with the reference symbol "v". The horizontal distance between two adjacent sensors, in each instance—in a top view—in other words sensor 3 relative to sensor 5, and sensor 5 relative to sensor 4, is at least as great as the distance "h" mentioned in connection with the exemplary embodiment shown in FIG. 2. Preferably, the vertical distance "v" is equal to or greater than 30 mm. The cutting mechanism disposed underneath the feed opening 2 is shown in a preferred position, schematically, in FIG. 4.

FIG. 5 shows a flow schematic for the functioning of the safety device on this new file shredder. When the sensors 3; 4; 5 are activated, they send a signal 10 to a circuit configuration 9 of the control unit 8 of the file shredder. If a signal 10 from two sensors 3; 4; 5 disposed adjacent to one another arrives in the circuit configuration 9, in each instance, the control unit 8 sends a turn-on signal 11 to a switch disposed in the circuit of the drive unit 7, thereby closing the switch and putting the drive unit, and thus also the cutting mechanism, into operation.

REFERENCE SYMBOL LIST

1 housing
2 feed opening
3 sensors
31 optical transmitter
32 optical receiver
4, 5 sensors
6 cutting mechanism
7 drive unit
8 control unit
9 switching device
10 signals
11 turn-on signal
h horizontal distance (between adjacent sensors)
v vertical distance (between adjacent sensors)
B width of item 2

The invention claimed is:

1. A file shredder comprising a cutting mechanism disposed in a housing, to which mechanism a drive unit is assigned, a control unit that stands in an effect connection with the drive unit, a feed opening that is let into the housing for feeding a data carrier into the housing in a feeding direction, said feed opening leading to the cutting mechanism, and a first sensor and a second sensor assigned to and disposed at a distance from one another in the feed opening for automatic start of the cutting mechanism, whereby the first sensor and the second sensor are connected with the control unit for automatic start of the cutting mechanism and the first sensor and the second sensor are spaced horizontally apart from each other with respect to the feeding direction, wherein the control unit sends a turn-on signal to the drive unit of the cutting mechanism only when a first signal from the first sensor and a second signal from the second sensor arrive in a circuit configuration disposed in the control unit.

2. The file shredder according to claim 1, wherein the horizontal distance between the first sensor and the second sensor is equal to or greater than 60 mm.

3. The file shredder according to claim 1, wherein at least one of the first sensor and the second sensor is a photoelectronic sensor.

4. The file shredder according to claim 1, wherein at least one of the first sensor and the second sensor is a mechanical sensor.

5. The file shredder according to claim 1, wherein at least one of the first sensor and the second sensor is a pneumatic sensor.

6. The file shredder according to claim 1, wherein at least one of the first sensor and the second sensor is an acoustical sensor.

7. The file shredder according to claim 1, wherein at least one of the first sensor and the second sensor is an electrical/electronic sensor.

8. The file shredder according to claim 1, wherein at least one of the first sensor and the second sensor is an optical sensor.

9. The file shredder according to claim 1, wherein the first signal and the second signal must arrive in the circuit configuration within a predetermined, variably adjustable time span, in order for a turn-on signal to be output.

10. The file shredder according to claim 9, wherein the said time span is equal to or less than two seconds.

11. A file shredder comprising a cutting mechanism disposed in a housing, to which mechanism a drive unit is assigned, a control unit that stands in an effect connection with the drive unit, a feed opening that is let into the housing for feeding a data carrier into the housing in a feeding direction, said feed opening leading to the cutting mechanism, and a first sensor and a second sensor assigned to and disposed at a distance from one another in the feed opening, for automatic start of the cutting mechanism, whereby the first sensor and the second sensor are connected with the control unit for automatic start of the cutting mechanism and the first sensor and the second sensor are spaced horizontally apart from each other with respect to the feeding direction, wherein the vertical distance between the first sensor and the second sensor is equal to or greater than 30 mm, and wherein the control unit sends a turn-on signal to the drive unit of the cutting mechanism only when a first signal from the first sensor and a second signal from the second sensor arrive in a circuit configuration disposed in the control unit.

12. The file shredder according to claim 11, wherein the horizontal distance between the first sensor and the second sensor is equal to or greater than 60 mm.

13. A file shredder comprising a cutting mechanism disposed in a housing, to which mechanism a drive unit is assigned, a control unit that stands in an effect connection with the drive unit, a feed opening that is let into the housing for feeding a data carrier into the housing in a feeding direction, said feed opening leading to the cutting mechanism, and a first sensor, a second sensor, and a third sensor assigned to and disposed at a distance from one another in the feed opening for automatic start of the cutting mechanism, whereby the first sensor, the second sensor, and the third sensor are connected with the control unit for automatic start of the cutting mechanism and the first sensor, the second sensor, and the third sensor are spaced horizontally apart from each other with respect to the feeding direction, wherein the control unit sends a turn-on signal to the drive unit of the cutting mechanism only when at least a first signal from the first sensor and a second signal from the second sensor arrive in a circuit configuration disposed in the control unit.

14. The file shredder according to claim 13, wherein at least one of the first sensor, the second sensor, and the third sensor is disposed on or in the feed opening offset relative to another of the first sensor, the second sensor, and the third sensor at a vertical distance, in addition to their horizontal distance.

* * * * *